US006273342B1

(12) United States Patent
Terada et al.

(10) Patent No.: US 6,273,342 B1
(45) Date of Patent: Aug. 14, 2001

(54) ATOMIZER

(75) Inventors: Takao Terada; Kei Asai; Kuniaki Matsuura, all of Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/509,993

(22) PCT Filed: Oct. 5, 1998

(86) PCT No.: PCT/JP98/04479

§ 371 Date: Apr. 5, 2000

§ 102(e) Date: Apr. 5, 2000

(87) PCT Pub. No.: WO99/17888

PCT Pub. Date: Apr. 15, 1999

(30) Foreign Application Priority Data

Oct. 6, 1997 (JP) ..... 9-271826

(51) Int. Cl.[7] ..... B05B 1/08; B05B 3/04

(52) U.S. Cl. ..... 239/102.2; 239/102.1

(58) Field of Search ..... 239/65, 74, 102.1, 239/102.2, 310; 310/317, 321–325; 128/200.14, 200.16

(56) References Cited

U.S. PATENT DOCUMENTS

| | | | | |
|---|---|---|---|---|
| 3,520,186 | * | 7/1970 | Adams et al. | 73/290 |
| 4,314,393 | * | 2/1982 | Wakatsuki et al. | 29/25.35 |
| 4,540,123 | | 9/1985 | Junger et al. | 239/102 |
| 4,632,311 | * | 12/1986 | Nakane et al. | 239/101 |
| 4,877,989 | * | 10/1989 | Drews et al. | 239/102.2 |
| 5,255,016 | * | 10/1993 | Usui et al. | 346/140 R |
| 5,518,179 | * | 5/1996 | Humberstone et al. | 239/102.2 |
| 5,697,248 | * | 12/1997 | Brown | 73/290 V |

FOREIGN PATENT DOCUMENTS

| | | |
|---|---|---|
| 55-13136 | 1/1980 | (JP) . |
| 9-66380 | 4/1984 | (JP) . |
| 9-209673 | 11/1984 | (JP) . |
| 5-277413 | 10/1993 | (JP) . |
| 7-68204 | 3/1995 | (JP) . |
| 7-80369 | 3/1995 | (JP) . |
| 7-116574 | 5/1995 | (JP) . |
| 7-232114 | 9/1995 | (JP) . |
| WO 93/20949 | 10/1993 | (WO) . |
| WO 97/05960 | 2/1997 | (WO) . |

* cited by examiner

*Primary Examiner*—David A. Scherbel
*Assistant Examiner*—Davis Hwu
(74) *Attorney, Agent, or Firm*—Morrison & Foerster LLP

(57) ABSTRACT

An atomizer includes a piezoelectric element 50 with comb-type electrodes having one electrode and the other electrode formed alternately at one side, a mesh member 40 having many small holes arranged in the proximity of a no-electrode formation plane of piezoelectric element 50, a liquid reagent bottle 20 storing a liquid L, and a solenoid 26 supplying the liquid L of liquid reagent bottle 20 between piezoelectric element 50 and mesh member 40. The vibratory wave of piezoelectric element 50 by an oscillation circuit is a bulk wave that travels within the piezoelectric element, not the surface wave propagating at the surface of the piezoelectric element defined by the comb-type electrode pitch. As a result, an atomizer can be provided improved in atomization efficiency and stabilized in atomization.

18 Claims, 17 Drawing Sheets

ATOMIZER

TECHNICAL FIELD

The present invention relates to an atomizer that sprays out liquid utilizing a piezoelectric element.

BACKGROUND ART

An atomizer of interest to the present invention is disclosed in, for example, International Publication Nos. WO93/20949 and WO97/05960. The conventional atomizer disclosed in these publications has a metal horn combined with a mesh member with many small holes to spray out liquid at low power consumption. In this atomizer, one end of the metal horn is immersed in the liquid in a reservoir. The mesh member is arranged at the other end of the metal horn. By the ultrasonic-vibration of the ultrasonic vibrator attached to the metal horn, liquid is absorbed from one end of the metal horn. The absorbed liquid is atomized by the synergistic effect between the metal horn that is vibrated ultrasonically and the mesh member.

However, such an atomizer has problems such as: 1̂ positioning between the mesh member and metal horn; and 2̂ stability of atomization. As to problem 1̂, the atomization action will become insufficient if the distance between the mesh member and the other end of the metal horn is too large or too small to degrade the atomization efficiency. As to problem 2̂, the structural distance between the mesh member and the metal horn is apt to become unstable to result in an unconstant atomization action. There was a problem that stable atomization is difficult.

DISCLOSURE OF THE INVENTION

In view of the foregoing, one object of the present invention is to provide an atomizer of favorable atomization efficiency.

Another object of the present invention is to provide an atomizer that can effect atomization stably.

In order to achieve the above objects, an atomizer of the present invention includes a piezoelectric element with comb-type electrodes having one electrode and the other electrode formed alternately, an oscillator to drive the piezoelectric element, a mesh member having many small holes arranged in close proximity to the piezoelectric element, a reservoir storing a liquid, and a liquid supply device supplying the liquid in the reservoir between the piezoelectric element and the mesh member. The vibratory wave used in the atomization of the piezoelectric element by the oscillator is a wave that travels mainly through the piezoelectric element (bulk wave).

In this atomizer, the piezoelectric element with comb-type electrodes having electrodes formed alternately are combined with a mesh member and uses the bulk wave that travels through the piezoelectric element. Therefore, a great oscillatory displacement is obtained with a small electrical energy. The atomization efficiency is favorable.

Preferably, the material of the piezoelectric element is lithium niobate with a 41±15° rotation Y cut and Y axis projection propagation direction. The oscillation efficiency is improved by the usage of a predetermined propagation direction of the material.

Preferably, the piezoelectric element has a thickness so that the oscillation frequency of the surface wave and the oscillation frequency of the bulk wave differ from each other. The comb-type electrode of the piezoelectric element is arranged so that the oscillation frequency of the surface wave differs from the oscillation frequency of the bulk wave. As a result, the oscillation frequency of the bulk wave is stabilized without rendering the oscillation circuit complicated.

Preferably, at least the end portion of the piezoelectric element crossing the advancing direction of the surface wave has a configuration so that the wave reflected at that end does not interfere with the surface wave. As a result, no interference of the vibratory wave (surface wave or bulk wave) occurs. Oscillation is stabilized.

Preferably, the piezoelectric element has two opposite planes. The comb-type electrode is provided only at one plane side of the piezoelectric element, opposite to the plane facing the mesh member. Since the comb-type electrode does not come into contact with the liquid( liquid reagent), electrode corrosion, electrical corrosion and electrical shorting by the liquid reagent can be prevented.

According to another aspect of the present invention, an atomizer includes a piezoelectric element with comb-type electrodes having one electrode and the other electrode formed alternately, an oscillator driving the piezoelectric element, a mesh member having many small holes arranged in close proximity to the piezoelectric element, a reservoir storing a liquid, and a liquid supply device supplying the liquid in the reservoir between the piezoelectric element and the mesh member. The mesh member is of a horn configuration in which the cross sectional shape of the small hole is defined according to the oscillation frequency of the piezoelectric element and the sound speed of the fluid. Since the cross sectional shape of the small hole of the mesh member is of a horn configuration that is defined according to the oscillation frequency of the piezoelectric element and the sound speed of the fluid, atomization of favorable efficiency can be achieved with a relatively small power.

According to a further aspect of the present invention, an atomizer includes a piezoelectric element with comb-type electrodes having one electrode and the other electrode formed alternately, an oscillator driving the piezoelectric element, a mesh member having many small holes arranged in close proximity to the piezoelectric element, a reservoir storing a liquid, and a liquid supply device supplying the liquid in the reservoir between the piezoelectric element and the mesh member. The piezoelectric element and the mesh member are arranged so that the planes facing each other cross at an acute angle. The liquid from the liquid supply device is provided from the opening side therebetween.

Also, there are provided a piezoelectric element with comb-type electrodes having one electrode and the other electrode formed alternately, an oscillator driving this piezoelectric element, a mesh member having a plurality of small holes arranged in close proximity to the piezoelectric element, a reservoir storing a liquid, and a liquid supply device supplying the liquid in the reservoir between the piezoelectric element and the mesh member. The piezoelectric element and the mesh member are arranged to have their facing planes cross each other at an acute angle. The reservoir includes a supply pipe extending to the opening side between the piezoelectric element and the mesh member.

As a result, the remaining amount of liquid in the reservoir can be minimized. Also, atomization is allowed of a liquid of low viscosity such as an agent dissolved with alcohol or a liquid of low surface tension including a surfactant.

According to still another aspect of the present invention, an atomizer includes a piezoelectric element with comb-type electrodes having one electrode and the other electrode formed alternately, an oscillator driving the piezoelectric element, a mesh member having many small holes arranged in close proximity to the piezoelectric element, a reservoir storing a liquid, and a liquid supply device supplying the liquid in the reservoir between the piezoelectric element and the mesh member. The piezoelectric element is characterized in that the circumferential end portion is pressed and fittedly held by waterproof packing. As a result, water resistance can be improved while minimizing the oscillatory attenuation of the piezoelectric element.

According to a still further aspect of the present invention, an atomizer includes a piezoelectric element with comb-type electrodes having one electrode and the other electrode formed alternately, an oscillator driving this piezoelectric element, a mesh member having many small holes arranged in close proximity to the piezoelectric element, a reservoir storing a liquid, and a liquid supply device supplying the liquid in the reservoir between the piezoelectric element and the mesh member. The piezoelectric element has a liquid sense electrode sensing the liquid from the reservoir at the comb-type electrode formation plane. A liquid sense circuit substrate is provided sensing whether there is a liquid or not according to the signal from the liquid sense electrode. The liquid sense circuit substrate is arranged below the comb-type electrode formation plane of the piezoelectric element. The liquid sense electrode of the piezoelectric element and the liquid sense circuit substrate are electrically connected by a conductive resilient body.

As a result, the distance between the liquid sense electrode of the piezoelectric element and the liquid sense circuit substrate can be minimized to reduce the influence of disturbance noise. Also, the electrostatic capacity at the electrical connection between the liquid sense electrode and the liquid sense circuit substrate can be reduced to improve the S/N. Furthermore, the contact reliability between the liquid sense electrode and the liquid sense circuit substrate can be ensured while minimizing the oscillation attenuation caused by electrical contact.

According to yet a further aspect of the present invention, an atomizer includes a piezoelectric element with comb-type electrodes having one electrode and the other electrode formed alternately, an oscillator driving this piezoelectric element, a mesh member having many small holes arranged in close proximity to the piezoelectric element, a reservoir storing a liquid, and a liquid supply device supplying the liquid in the reservoir between the piezoelectric element and the mesh member. The liquid supply means is characterized in supplying the liquid in the reservoir by the press-operation of a diaphragm.

Also, an atomizer includes a piezoelectric element with comb-type electrodes having one electrode and the other electrode formed alternately, an oscillator driving this piezoelectric element, a mesh member having many small holes arranged in close proximity to the piezoelectric element, a reservoir storing a liquid, a liquid supply device supplying the liquid in the reservoir between the piezoelectric element and the mesh member, and a liquid amount sensor sensing the amount of liquid on the piezoelectric element. The liquid supply device supplies the liquid in the reservoir by press-operation of a diaphragm. The press-operation of the diaphragm is controlled according to the output of the liquid amount sensor.

As a result, the liquid of an optimum amount can be supplied to solve any inconvenience such as supply clogging or the like.

According to yet another aspect of the present invention, an atomizer includes a piezoelectric element with comb-type electrodes having one electrode and the other electrode formed alternately, an oscillator driving this piezoelectric element, a mesh member having many small holes arranged in close proximity to the piezoelectric element, a reservoir storing a liquid, a liquid supply device supplying the liquid in the reservoir between the piezoelectric element and the mesh member, and a mesh member case holding the mesh member. The mesh member case is formed of metal or ceramic.

As a result, the absorption of the oscillation energy that propagates through the liquid can be suppressed to improve the atomization efficiency. Also, the shock strength with respect to impact such as when dropping the apparatus is increased. An atomizer with a mesh member case that is not easily damaged can be provided.

According to yet a still further aspect of the present invention, an atomizer includes a main unit, a main unit cover attached removably to the main unit, a piezoelectric element, an oscillator driving this piezoelectric element, a mesh member having many small holes arranged in close proximity to the piezoelectric element, a reservoir storing a liquid, and a liquid supply device supplying the liquid in the reservoir between the piezoelectric element and the mesh member. The oscillator is arranged at the main unit whereas the piezoelectric element, the mesh member, the reservoir, and the liquid supply device are arranged at the main unit cover.

Since the piezoelectric element, the mesh member, the reservoir and the liquid supply device are arranged at the main unit cover in the atomizer, the maintenance is facilitated by removing the main unit cover from the main unit with the components as modular components. Assembly is facilitated. Particularly the main unit cover or the circuit substrate arranged within the main unit, when damaged, can be replaced easily. As to the atomization mechanism portion at the part of the main unit cover that requires critical adjustment, the accuracy can be maintained by providing the same as modular components that cannot be easily detached.

According to yet a still further aspect of the present invention, an atomizer includes, at a main unit, a piezoelectric element, an oscillator driving this piezoelectric element, a mesh member having many small holes arranged in close proximity to the piezoelectric element, a reservoir storing a liquid, and a liquid supply device supplying the liquid in the reservoir between the piezoelectric element and the mesh member. An operation display and a voltage monitor display are provided at the upper portion of the main unit. These displays are arranged so as to allow visual confirmation in a direction substantially identical to the spray out direction from the main unit.

Since the operation display and the voltage monitor display can be easily visualized during inhalation of the spray, confirmation of the conductive state during inhalation and confirmation of the warning display when the battery is low can be carried out easily in the inhalation posture.

According to an additional aspect of the present invention, an atomizer includes, at a prismatic main unit, a piezoelectric element, an oscillator driving this piezoelectric element, a mesh member having many small holes arranged in close proximity to the piezoelectric element, a reservoir storing a liquid, and a liquid supply device supplying the liquid in the reservoir between the piezoelectric element and the mesh member. The main unit includes a projection protruding backwards at the rear of the upper portion, an atomize unit at the upper portion, and an operation switch at the front of the upper portion corresponding to the projection.

According to the present atomizer, the operation switch can be operated while holding the main unit with a natural grip. The possibility of dropping the apparatus erroneously during operation is reduced.

BEST MODES FOR CARRYING OUT THE INVENTION

Embodiments of the present invention will be described hereinafter with reference to the drawings.

Figure 1:
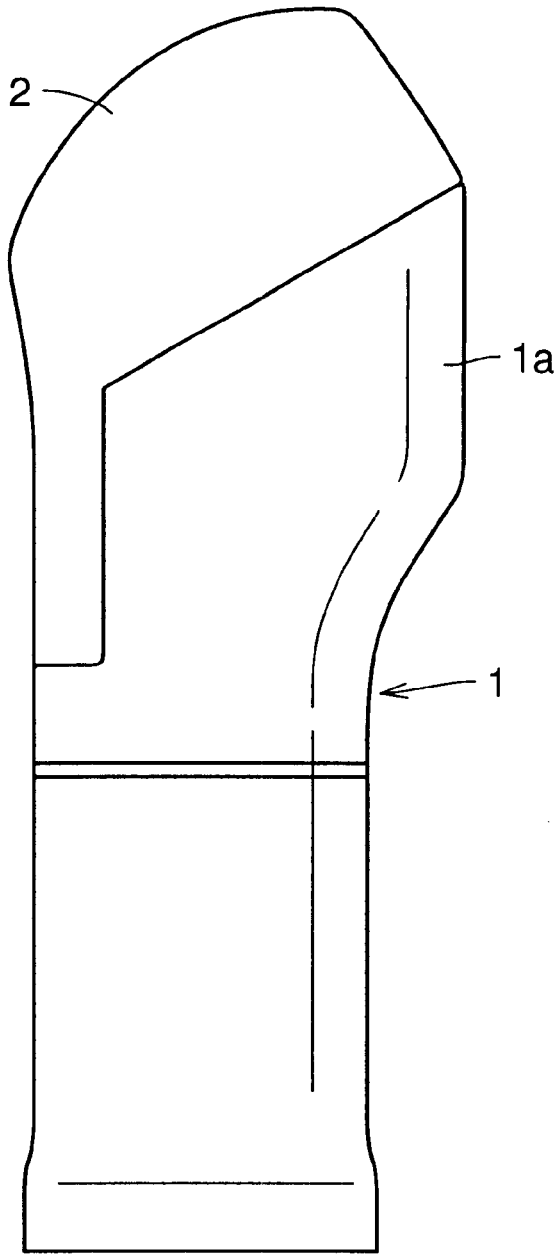
FIG. 1 is a side view of an atomizer according to an embodiment of the present invention.
Figure 2:
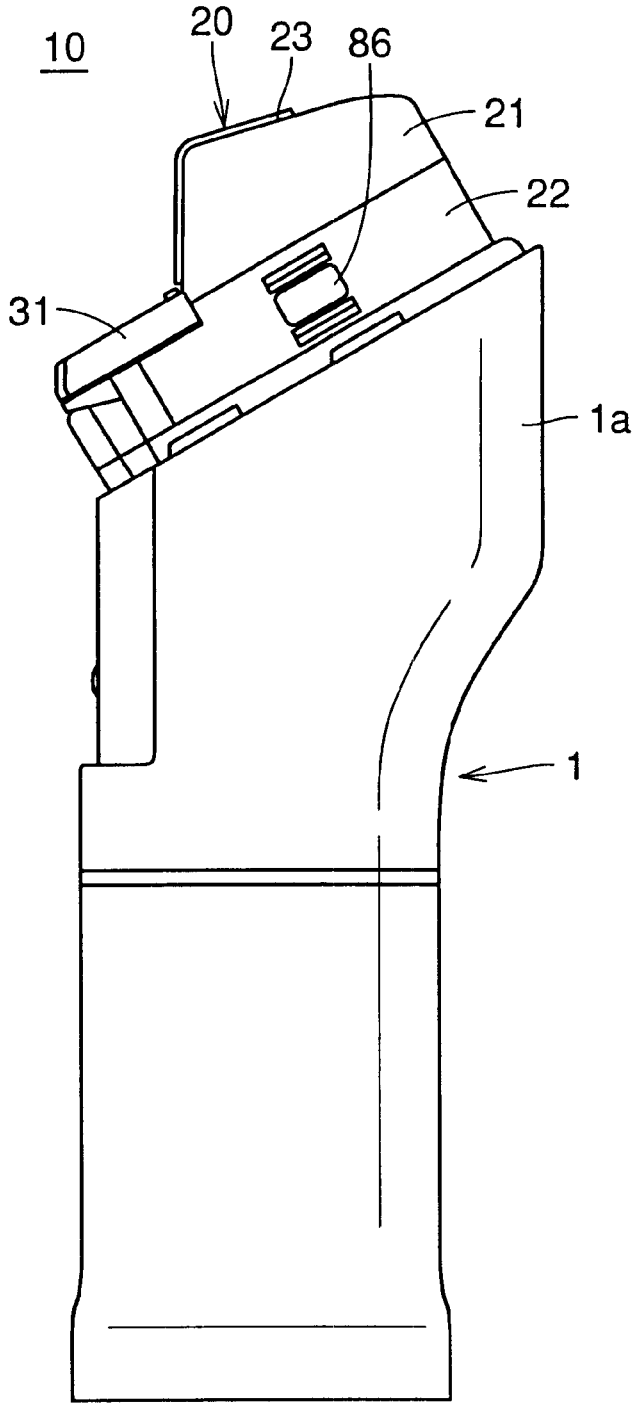
FIG. 2 is a side view of an atomizer with the cover removed from the main unit case.

Referring to FIGS. 1 and 2, an atomizer according to the present embodiment includes a prismatic main unit case (main unit) 1, and a cover 2 attached removably to main unit case 1. Main unit case 1 includes a projection la protruding backwards at the back side of the upper portion, and an operation switch 9 for turning ON/OFF the power at the front face of the upper portion corresponding to projection 1*a*.

Referring to FIGS. 4–9, a main unit cover 10 appears at the upper portion of main unit case when cover 2 is removed from main unit case 1. Main unit cover 10 is detachable with respect to main unit case 1. A piezoelectric element 50, a mesh member 40, a reservoir, and a liquid supply unit that will be described afterwards are arranged at main unit cover 10.

Main unit cover 10 includes a liquid reagent bottle (reservoir) 20 storing a liquid (for example, liquid reagent). Liquid reagent bottle 20 is formed of an upper part 21 and a lower part 22. Lower and upper parts 21 and 22 are fitted to each other. A cap 23 that seals a liquid reagent inlet 21*a* that can be opened/closed is attached to upper part 21. Liquid reagent can be introduced into liquid reagent bottle 21 from liquid reagent inlet 21*a* by opening cap 23. A diaphragm 24 is attached at the bottom of liquid reagent bottle 20 (lower part 22). A liquid supply pipe 25 is attached at the slanting lower side of lower part 22. The liquid reagent is arbitrary. In the atomizer of the present invention, a liquid of low viscosity such as chemicals dissolved in alcohol or a liquid of low surface tension including a surfactant can be sprayed out.

Figure 10:
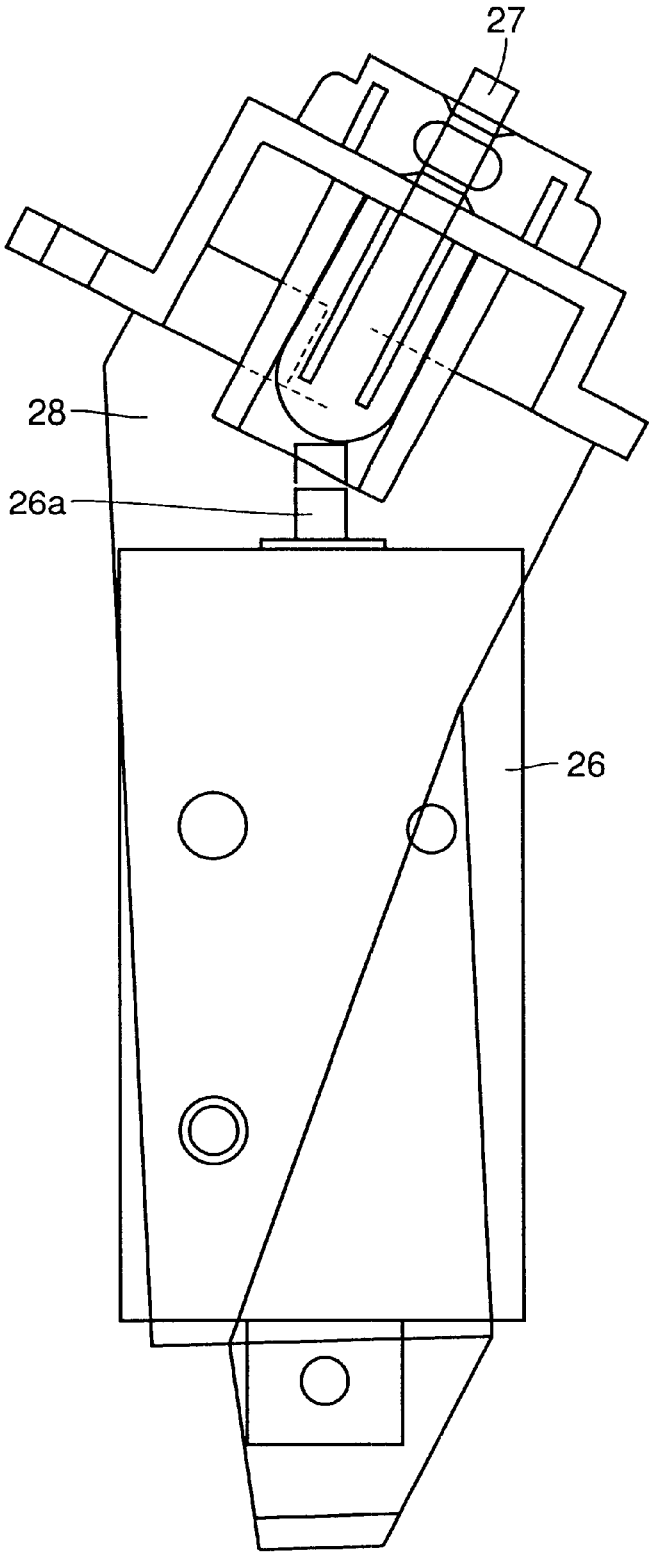
FIG. 10 is an enlarged view of a solenoid used in an atomizer.

A solenoid 26 is provided at the lower portion of liquid reagent bottle 20 to urge diaphragm 24 to supply a liquid. As shown in FIG. 10, solenoid 26 is attached to a solenoid holder 28 where a solenoid shaft 26*a* pushes a pin 27. Pin 27 is in contact with diaphragm 24 in the normal state. Upon actuation of solenoid 26, solenoid shaft 26*a* pushes pin 27, which in turn urges diaphragm 24. As a result, the liquid in liquid reagent bottle 20 is appropriately discharged through liquid supply pipe 25.

According to this liquid reagent supply structure, an optimum amount of liquid reagent can be supplied by appropriately setting the displacement of diaphragm 24 caused by the urge of pin 27. Thus, inconvenience such as supply clogging can be prevented. Conventionally, the liquid was supplied taking advantage of the weight of the liquid reagent itself or the capillary phenomenon through a thin pipe from the liquid reagent tank. There was the inconvenience that, depending upon the concentration and status of the liquid reagent, an appropriate amount could not be supplied or supply clogging occurred.

As an alternative to solenoid 26, pin 27 can be operated using a motor, or pin 27 can be operated by air pressure.

Figure 11A:
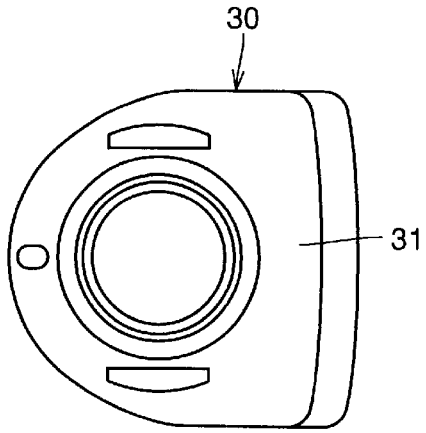
FIGS. 11A and 11B are a top view and a side view, respectively, of an atomize unit at a main unit cover of an atomizer.
Figure 11B:
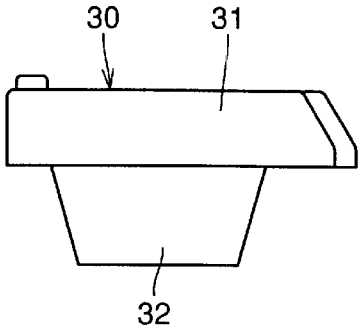
Figure 12A:
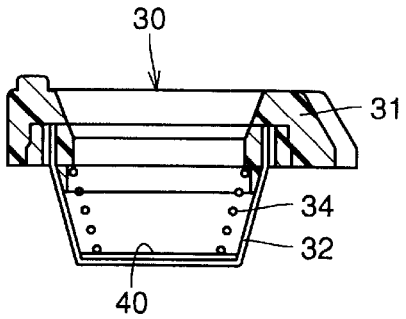
FIGS. 12A and 12B are a cross sectional view and a top view, respectively, of the interior of the atomize unit shown in FIGS. 11A and 11B.
Figure 12B:
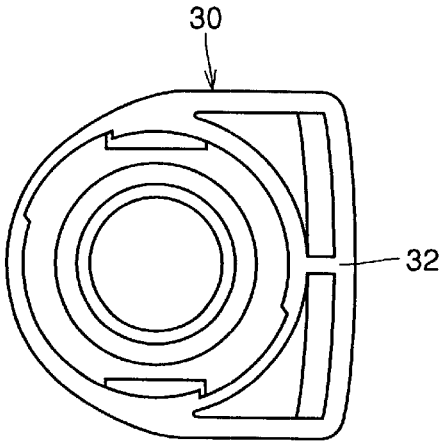

An atomize unit 30 is provided at the lower part 22 of liquid reagent bottle 20. Atomize unit 30 has a structure as shown in FIG. 11A (top view), FIG. 11B (side view), FIG. 12A (sectional view) and FIG. 12B (top view with upper case removed). Atomize unit 30 includes an upper case 31 and a lower case 32 which are fitted to each other. A mesh member case is formed by upper and lower cases 31 and 32. At lower case 32 are provided a mesh member 40 with many small holes and a coil spring 34 urging mesh member 40 against lower case 32. Spring 34 has one end engaged with upper case 31 and the other end engaged with the perimeter of mesh member 40. Accordingly, mesh member 40 is held constantly, urged against lower case 32.

Mesh member 40 is formed of metal or ceramic in order to suppress the absorption of oscillation energy conveyed to the liquid reagent to improve the atomization efficiency and increase the shock strength when main unit cover 10 is dropped. More specifically, the liquid reagent is in contact with mesh member 40 during atomization and also in contact with the mesh member case (upper and lower cases 31 and 32) holding mesh member 40 at the same time. Conventionally, the mesh member case is formed of resin, so that the vibration of the liquid reagent and the mesh member will be attenuated by the resin mesh member case. By forming the mesh member case of metal or ceramic as in the present invention, such problems can be eliminated.

Figure 13:
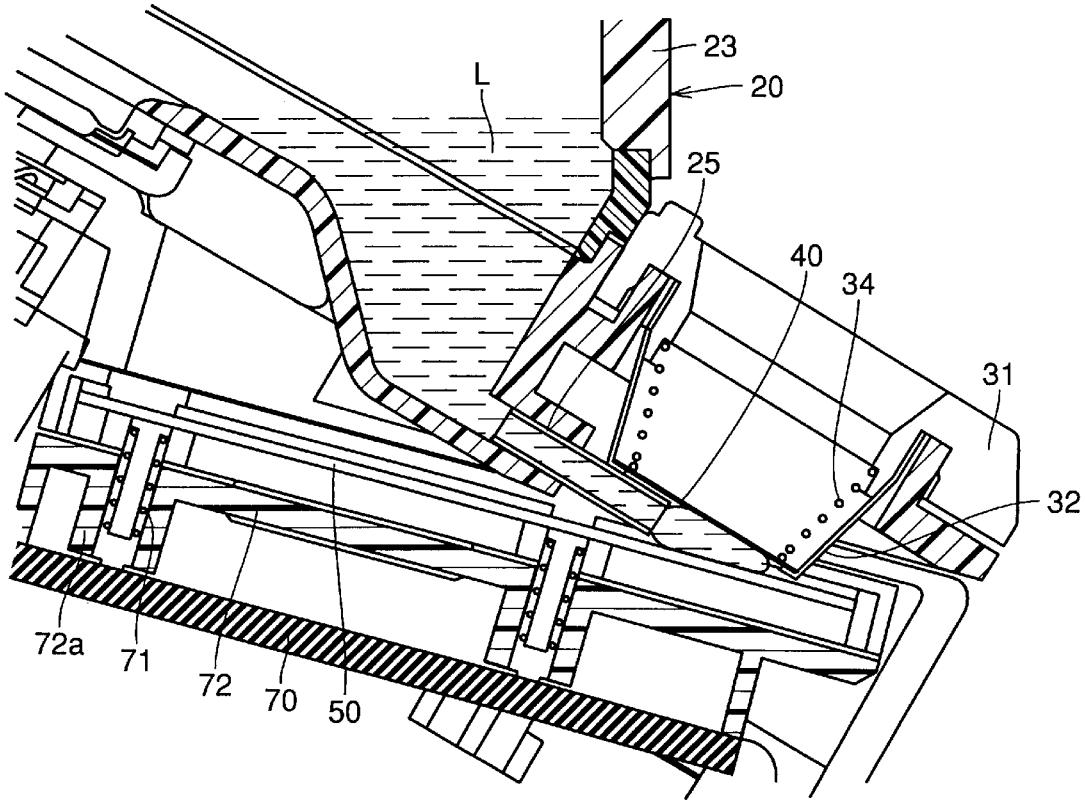
FIG. 13 is an enlarged sectional view of the main part of a main unit cover of an atomizer.
Figure 14:
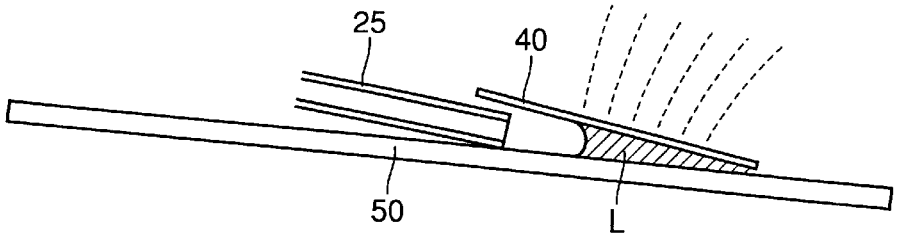
FIG. 14 is a diagram describing atomization at the main unit cover of the atomizer.

As shown by the enlarged sectional view of the main part of FIG. 13, a piezoelectric element 50 is positioned in an oblique manner in close proximity at the lower portion of mesh member 40 positioned oblique with respect to the horizontal plane. Mesh member 40 and piezoelectric element 50 have their facing planes cross each other at an acute angle to have liquid reagent L from liquid supply pipe 25 supplied from the open side therebetween. By the above structure, the remaining amount of liquid reagent L in liquid reagent bottle 20 can be minimized. Also, a liquid of low viscosity can be atomized. When the remaining amount of liquid reagent L in liquid reagent bottle 20 becomes low so that liquid L supplied from liquid supply pipe 25 is reduced, liquid reagent L will be atomized by the surface tension with mesh member 40 up to the last drop, as shown in FIG. 14. Liquid reagent L can be used for spray out with no waste.

Although not shown in the drawing, a liquid amount sensor that senses the amount of liquid reagent on piezoelectric element 50 can be provided to control the urge operation of diaphragm 24 according to the output of this liquid amount sensor.

Figure 15:
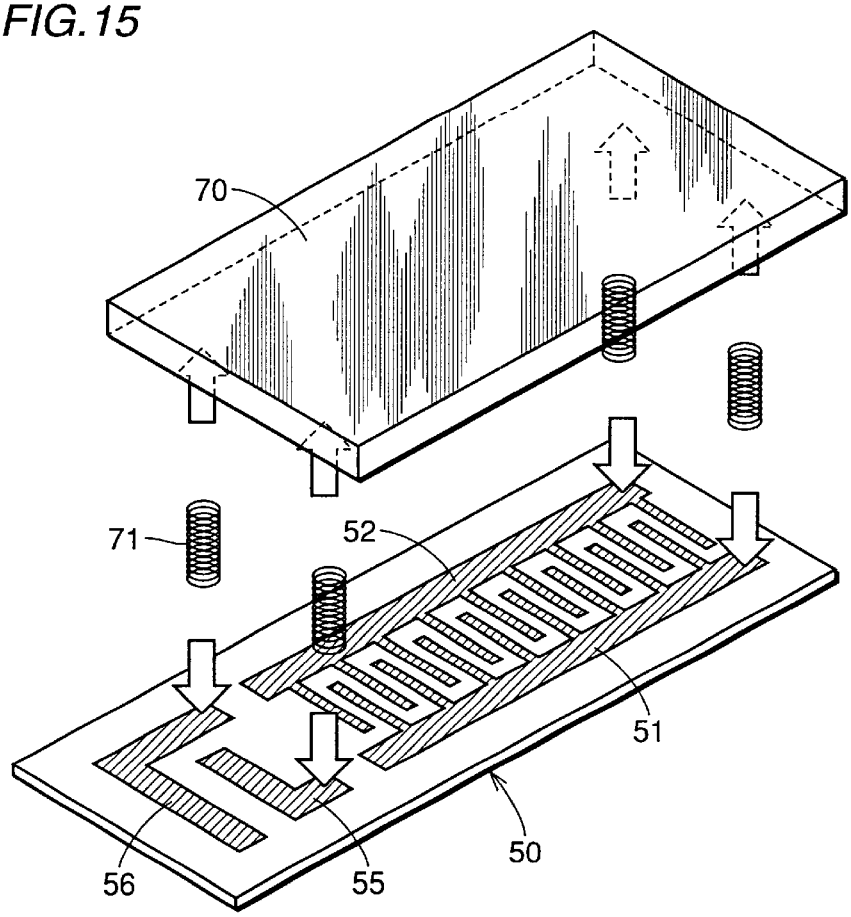
FIG. 15 is a perspective view of a piezoelectric element and a liquid sensor circuit substrate used in an atomizer.
Figure 16:
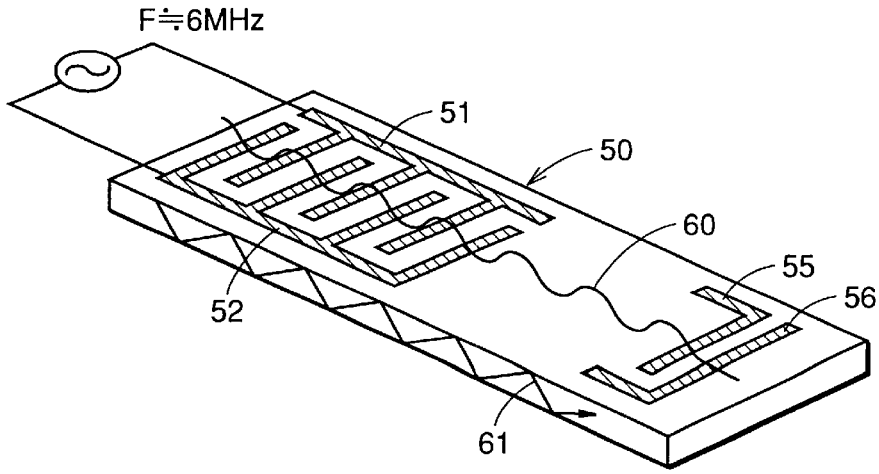
FIG. 16 is a perspective view showing a piezoelectric element used in an atomizer.

As shown in FIGS. 15 and 16, piezoelectric element 50 includes comb-type electrodes having one electrode 51 and the other electrode 52 formed alternately at one plane, and liquid sense electrodes 55, 56 formed on the same plane and at a position in contact with the liquid reagent supplied from liquid supply pipe 25. Piezoelectric element 50 is arranged so that the plane (no-electrode formation plane) opposite to the plane where electrodes 51, 52, 55 and 56 are formed faces mesh member 40. This is because the vibratory wave of piezoelectric element 50 used for atomization is a bulk wave 61 traveling therethrough, not the conventional surface wave 60. By arranging the no-electrode formation plane of piezoelectric element 50 so as to face mesh member 40, the electrodes will not come into contact with the liquid reagent. The apparatus can be protected from electrode corrosion, electric corrosion and electrical shorting caused by the liquid reagent. Thus, reliability is improved.

Although not particularly limited, the material of piezoelectric element 50 is preferably lithium niobate with a 41±15° rotation Y cut and a Y axis projection propagation direction from the standpoint of utilizing a bulk wave as an vibratory wave.

Although not depicted in the drawing, piezoelectric element 50 has its circumferential end portion pressed and fitted by waterproof packing. In piezoelectric element 50, the comb portion where comb-type electrodes 51 and 52 are formed oscillates. The oscillation of the circumferential end portion of piezoelectric element 50 is smaller than that of the electrode formation portion. By press-holding only the circumferential end portion of piezoelectric element 50, the oscillation attenuation of piezoelectric element 50 can be minimized. Also, the liquid reagent supplied to the no-electrode formation plane of piezoelectric element 50 flows outside piezoelectric element 50, so that corrosion, deformation, discolor or the like inside the atomizer can be prevented by the waterproof packing.

A liquid sense circuit substrate 70 is arranged beneath the electrode formation plane of piezoelectric element 50. Liquid sense circuit substrate 70 is electrically connected with comb-type electrodes 51 and 52 and liquid sense electrodes 55 and 56 of piezoelectric element 50 through a conductive coil spring (resilient body) 71. Liquid sense circuit substrate 70 is mounted with a circuit that senses the absence/presence of liquid according to a signal from liquid sense electrodes 55 and 56. Coil spring 71 is inserted into a hollow shaft 72*a* of a support panel 72.

By the above structure, the distance from liquid sense electrodes 55 and 56 of piezoelectric element 50 from liquid sense circuit substrate 70 is minimized to reduce the influence of disturbance noise (mainly noise caused by vibration drive oscillation signal). Also, the electrostatic capacity of the electrical connection between liquid sense electrodes 55 and 56 and liquid sensor circuit substrate 70 can be reduced to improve the S/N. More specifically, the electrostatic capacity causing a change in liquid sense electrodes 55 and 56 is approximately several pF since the liquid reagent is in contact and spreads at the backside plane (no-electrode formation plane) of liquid sense electrodes 55 and 56. This change is sensed by liquid sense circuit substrate 70. The usage of a conductive coil spring 71 ensures the contact between electrodes 51, 52, 55 and 56 and liquid sense circuit substrate 70 while minimizing the vibration attenuation of piezoelectric element 50 caused by contact with electrodes 51, 52, 55 and 56.

The oscillation operation of piezoelectric element 50 will be described hereinafter. Upon conducting an alternating current of frequency 6 MHz, for example, across electrodes 51 and 52 of piezoelectric element 50, a surface wave propagating at the surface (resilient surface wave) 60 and a bulk wave 61 that travels through the interior are generated. In other words, the electrical energy of piezoelectric element 50 is converted into oscillation energy. More specifically, electrodes 51 and 52 convert the electrical energy into mechanical oscillation energy.

Figure 17:
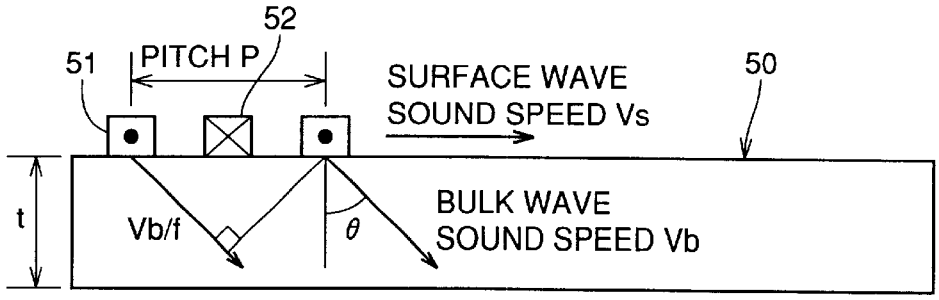
FIG. 17 is a diagram describing the vibration principle of a piezoelectric element used in an atomizer.

In piezoelectric element 50, the oscillation source of piezoelectric element 50 is comb-type electrodes 51 and 52 formed alternately with respect to each other. The generated vibratory waves are a surface wave 60 and a bulk wave 61. As shown in FIG. 17, bulk wave 61 travels inside piezoelectric element 50 obliquely with respect to the longitudinal direction of piezoelectric element 50. When the direction of the normal line of the equiphase surface of the excited bulk wave is θ, θ is represented by the following equation. The advancing direction of the bulk wave depends upon the frequency.

$$\theta=\sin^{-1}(Vb/P\cdot f)$$

where Vb is the phase speed of the bulk wave, P is the pitch of comb-type electrodes 51 and 52, and f is the frequency.

The bulk wave is propagated while being reflected at the boundary plane of piezoelectric element 50. The oscillation frequency of the excited surface wave at comb-type electrodes 51 and 52 is determined mainly by the sound speed Vs of the surface wave and pitch P. The oscillation frequency of the bulk wave is determined by the thickness t of piezoelectric element 50.

When the oscillation frequency of the surface wave approximates the oscillation frequency of the bulk wave, there is the case where the frequency is not stable to cause piezoelectric element 50 operate at the oscillation frequency of the surface wave or of the bulk wave in response to a slight change in the oscillation load. The structure of the oscillation circuit becomes complicated to prevent this event. It is therefore important to select thickness t of piezoelectric element 50 so that the oscillation frequency of the bulk wave differs from the oscillation frequency of the surface wave.

Figure 18A:
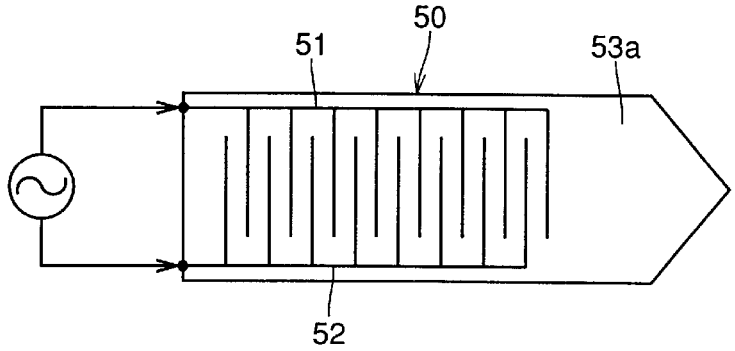
FIGS. 18A, 18B and 18C show examples of the configuration of a no-electrode formation portion of a piezoelectric element used in an atomizer.
Figure 18B:
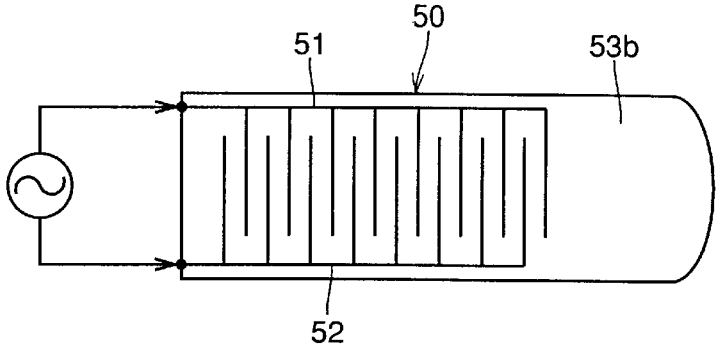
Figure 18C:
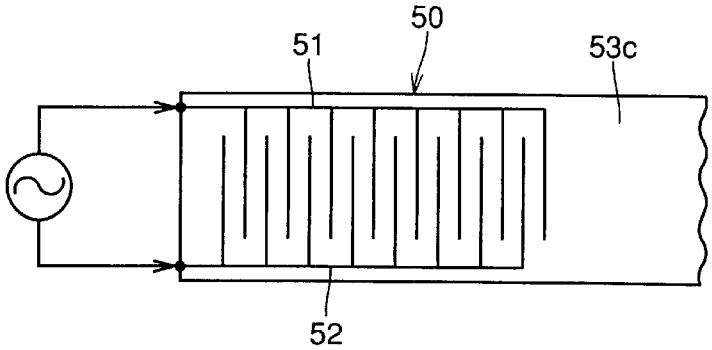

The bulk wave and the surface wave are reflected at both end portions crossing the wave propagation direction to cause wave interference. This is not desirable from the standpoint of vibration stability. It is preferable to set the two end portions crossing the wave propagation direction asymmetric or at least the side face of the end portion nonplanar. Examples thereof are indicated in FIGS. 18A, 18B, 18C and FIGS. 19A, 19B and 19C. FIG. 18A shows an example of a tapered no-electrode formation portion 53*a* of piezoelectric element 50. FIG. 18B shows an arc-shaped no-electrode formation portion 53*b*. FIG. 18C shows a waveform no-electrode formation portion 53*c*. These configurations cancel the reflection of surface wave 60 or bulk wave 61 of FIG. 16 to eliminate vibratory wave interference. Thus, oscillation becomes stable.

Figure 19A:
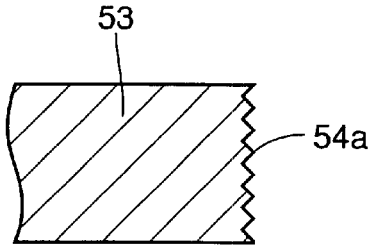
FIGS. 19A, 19B and 19C show an example of the end configuration of a no-electrode formation portion of a piezoelectric element used in an atomization device.
Figure 19B:
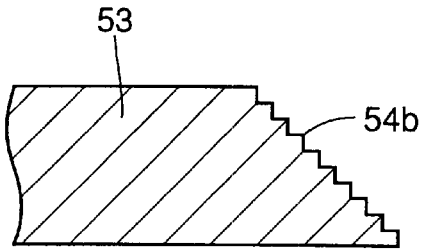
Figure 19C:
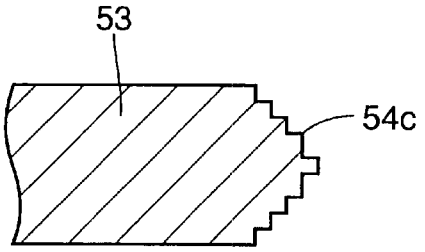

In addition to altering the configurations of no-electrode formation portions 53*a*–53*c* of piezoelectric element 50, the end plane of no-electrode formation portion 53 can be set nonplanar as shown in FIGS. 19A, 19B and 19C. FIG. 19A shows a saw tooth end plane 54*a*. FIG. 19B shows an end plane 54*b* with one stepped side. FIG. 19C shows an end plane 54*c* with both stepped sides. Similarly in this case, reflection of surface wave 60 or bulk wave 61 can be cancelled. The configuration of end planes 54*a*–54*c* may be incorporated, not only at the end plane of no-electrode formation portion 53, but also at the end plane portion at the side opposite to no-electrode formation portion 53 (the portion where electrodes 51 and 52 are formed). Alternatively, these configurations can be provided over the entire end plane of piezoelectric element 50. Also, the configurations of no-electrode formation portions 53*a*–53*c* in FIGS. 18A, 18B and 18C can be combined with the configurations of end planes 54*a*–54*c* in FIGS. 19A, 19B and 19C.

Figure 4:
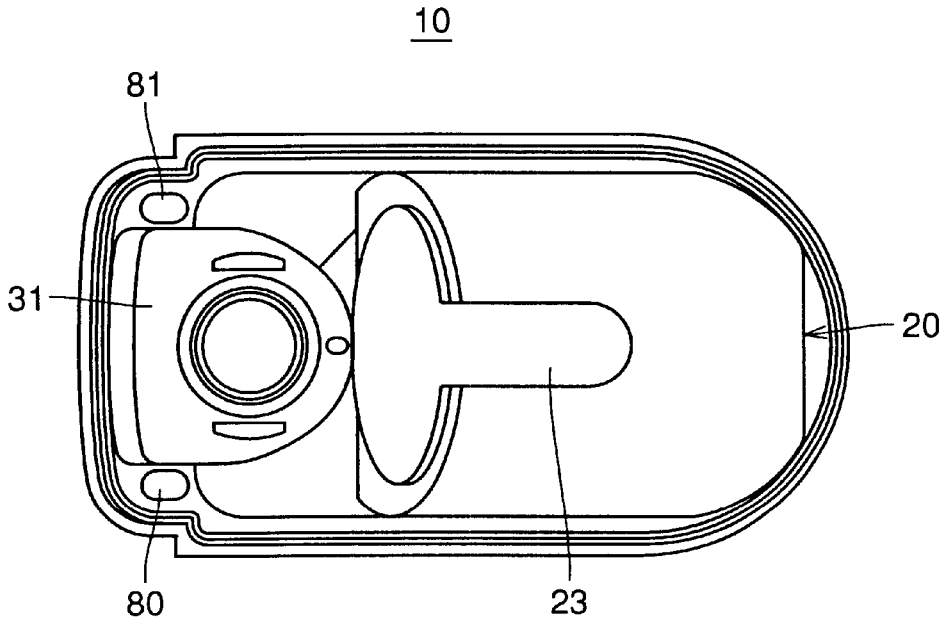
FIG. 4 is a top view of the atomizer of FIG. 2.
Figure 5:
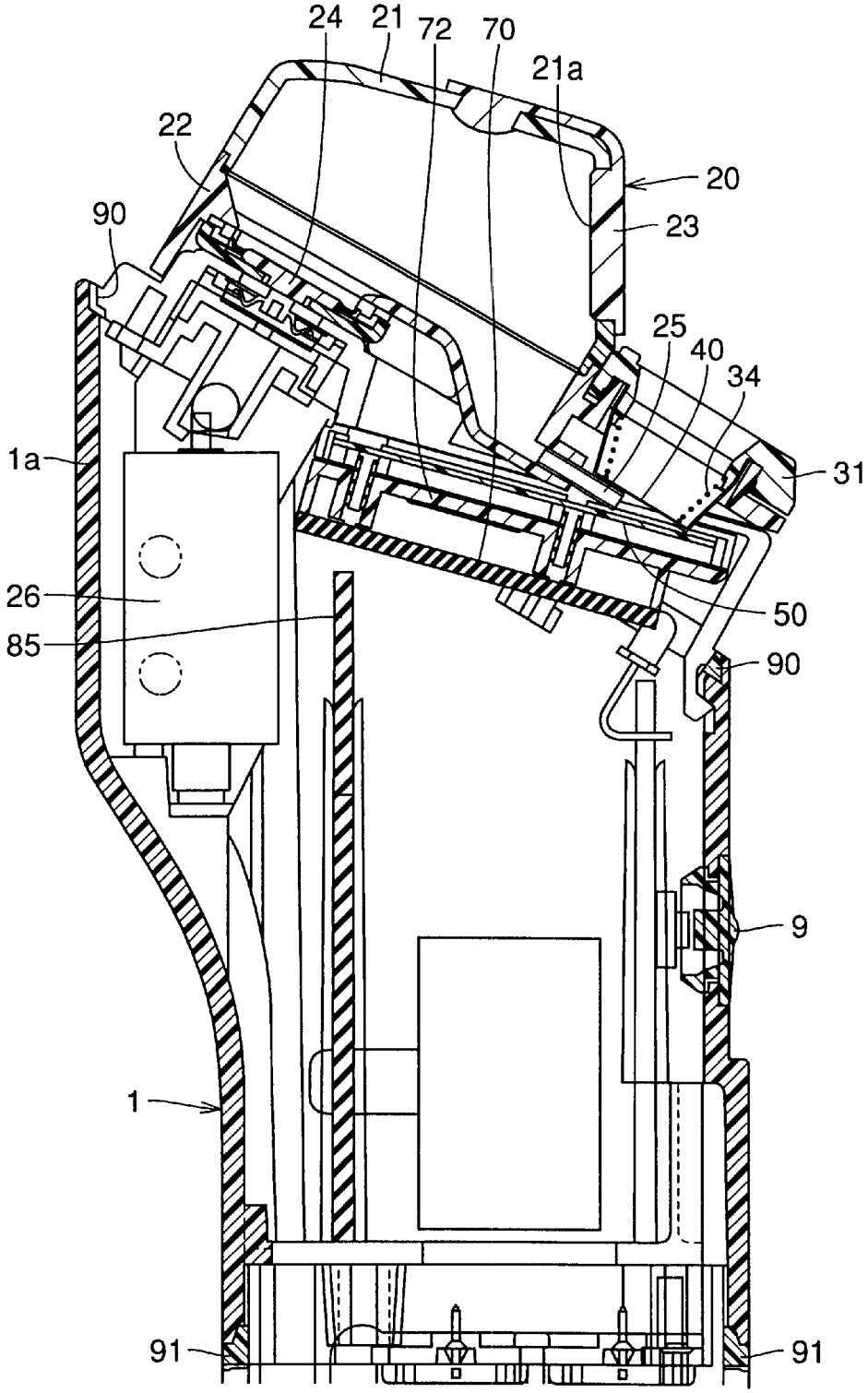
FIG. 5 is a sectional view of the main part of the atomizer.
Figure 6A:
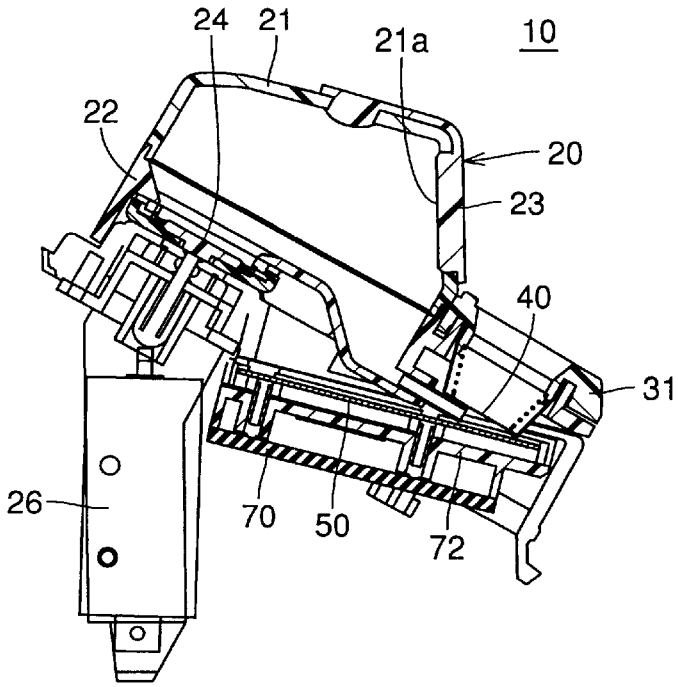
FIGS. 6A and 6B are sectional views in a partially broken away form of an atomizer with the cover removed from the main unit case.
Figure 6B:
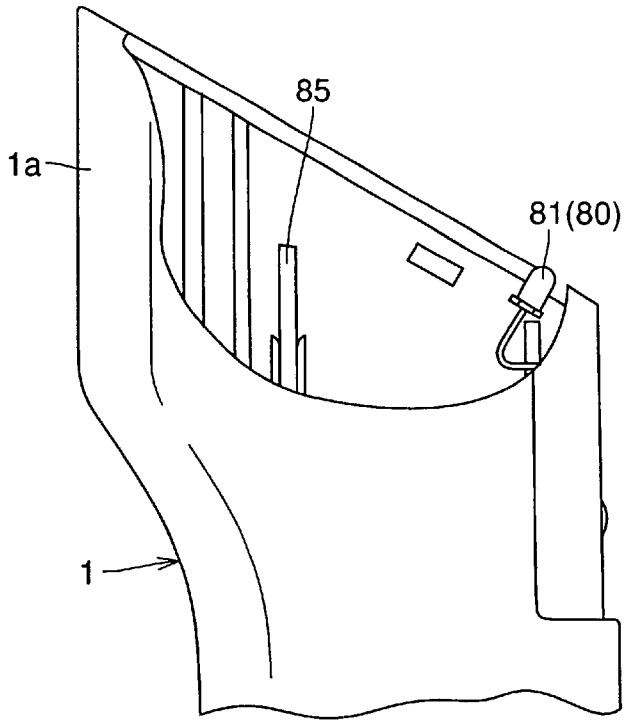
Figure 7A:
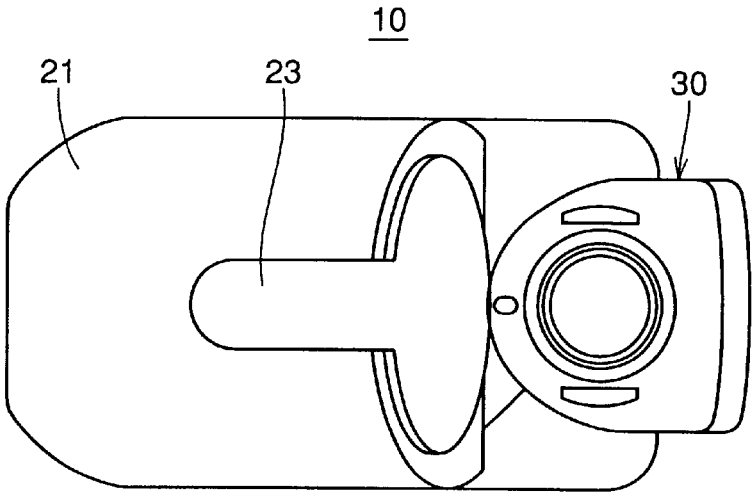
FIGS. 7A and 7B are a top view and a side view, respectively, of the main unit cover of an atomizer.
Figure 7B:
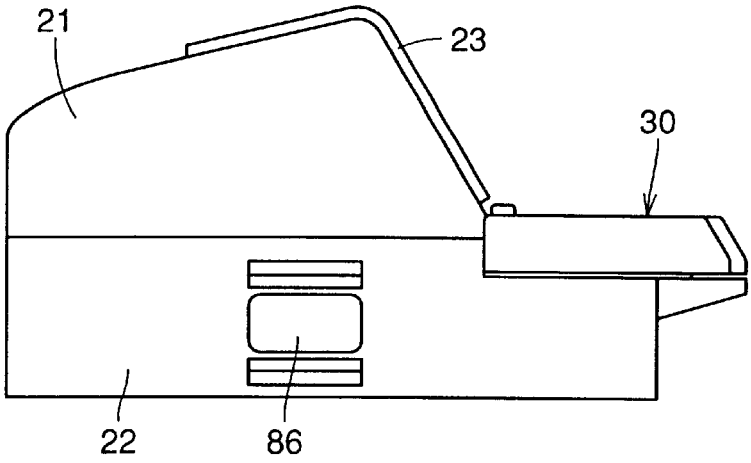
Figure 8A:
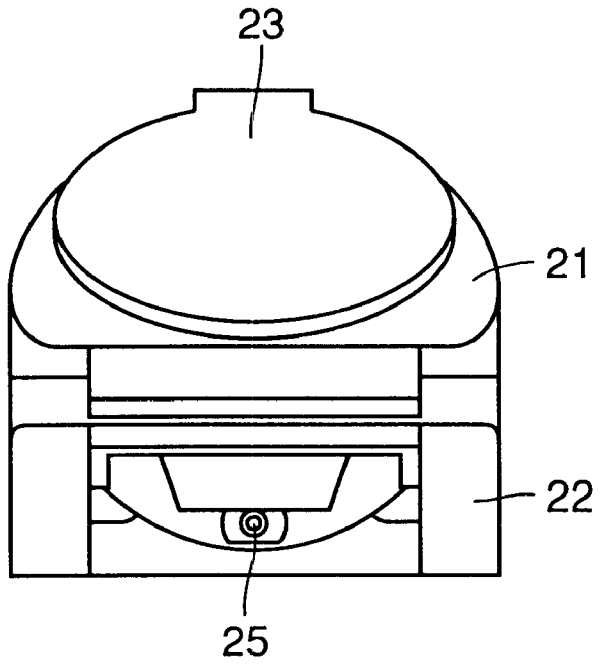
FIGS. 8A and 8B are a right side view and a left side view, respectively, of the main unit cover of FIGS. 7A and 7B.
Figure 8B:
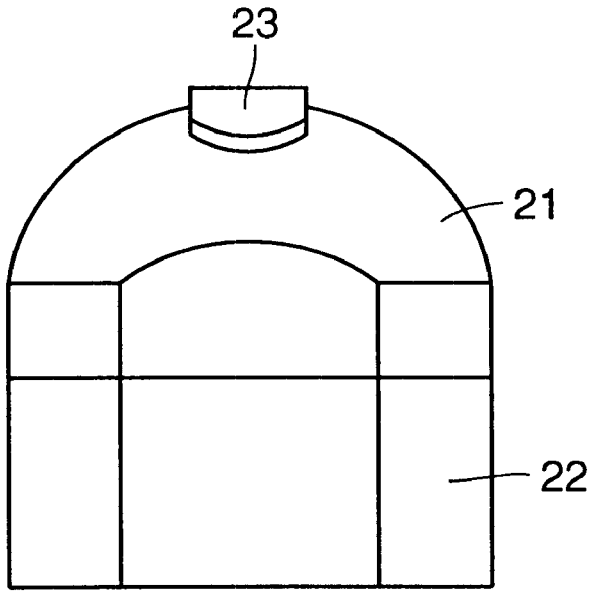
Figure 9:
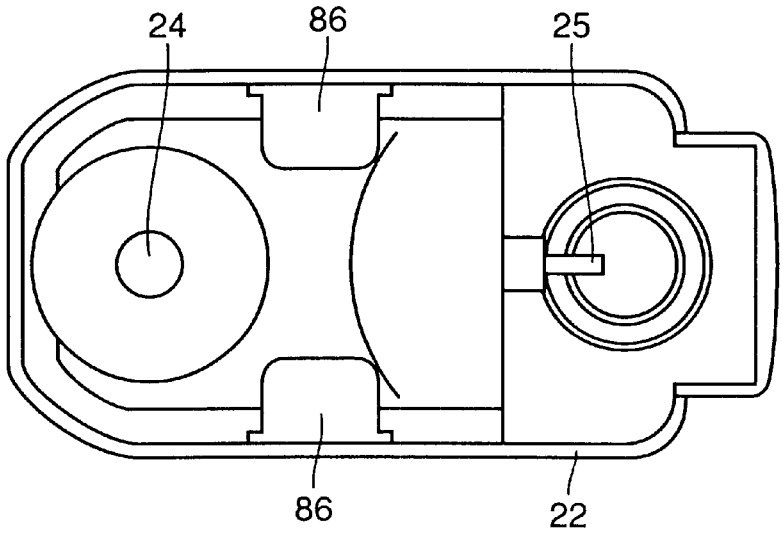
FIG. 9 is a top view showing the interior of the main unit cover of FIGS. 7A and 7B.

At upper case 31 of atomize unit 30 at main unit cover 10 in FIG. 4 (also refer to FIGS. 6A and 6B), an operation display LED 80 and a voltage monitor display LED 81 are provided. LEDs 80 and 81 are arranged in a direction substantially identical to the spray out direction from main unit cover 10 (the direction perpendicular to mesh memory 40) in a viewable manner. Operation display LED 80 is lit when operation switch 9 is turned on. Voltage monitor display LED 80 is lit when the remaining battery is low. Accordingly, the conductive state and whether the battery is low or not can be confirmed visually by the lights of LEDs 80 and 81 turned on or off during inhalation. In FIGS. 5, 6A and 6B, a control circuit substrate 85 to control the ON/OFF of solenoid 26 is arranged vertically in main unit case 1.

The present atomizer includes a formed component constituting the main body of the apparatus such as main unit case 1, cover 2, and main unit cover 10, and another formed component fitted to such components. Packing to ensure waterproof ability at the fitted portion is integrally formed to one or both of the formed components. More specifically, in FIG. 5, packing 90 is integrally formed at the fitting portion between main unit case 1 and main unit cover 10, and packing 91 is integrally formed at the fitting portion with the battery storage unit at the lower portion of main unit case 1. Accordingly, the waterproof reliability is improved as well as the assembly property.

Figure 20:
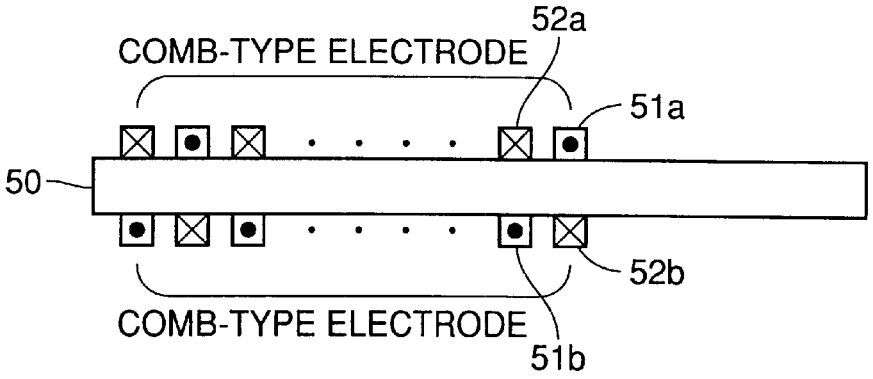
FIG. 20 is a side view showing the case where comb-like electrodes are provided at both sides of a piezoelectric element.

According to the present embodiment, the comb-type electrodes are provided only at one side of the piezoelectric element. However, the comb-type electrode can be provided at both sides of the piezoelectric element. Such an example is shown in FIG. 20. Referring to FIG. 20, comb-type electrodes 51*a*, 52*a*, 51*b* and 52*b* are provided at both sides of piezoelectric element 50. In this case, the comb-type electrodes are arranged so that the phase of the vibratory wave (bulk wave) generated by the comb-type electrodes provided at both sides is maximized according to wave mechanics.

As a result, an oscillation greater than that where only one side is provided with the comb-type electrodes can be obtained.

Figure 21:
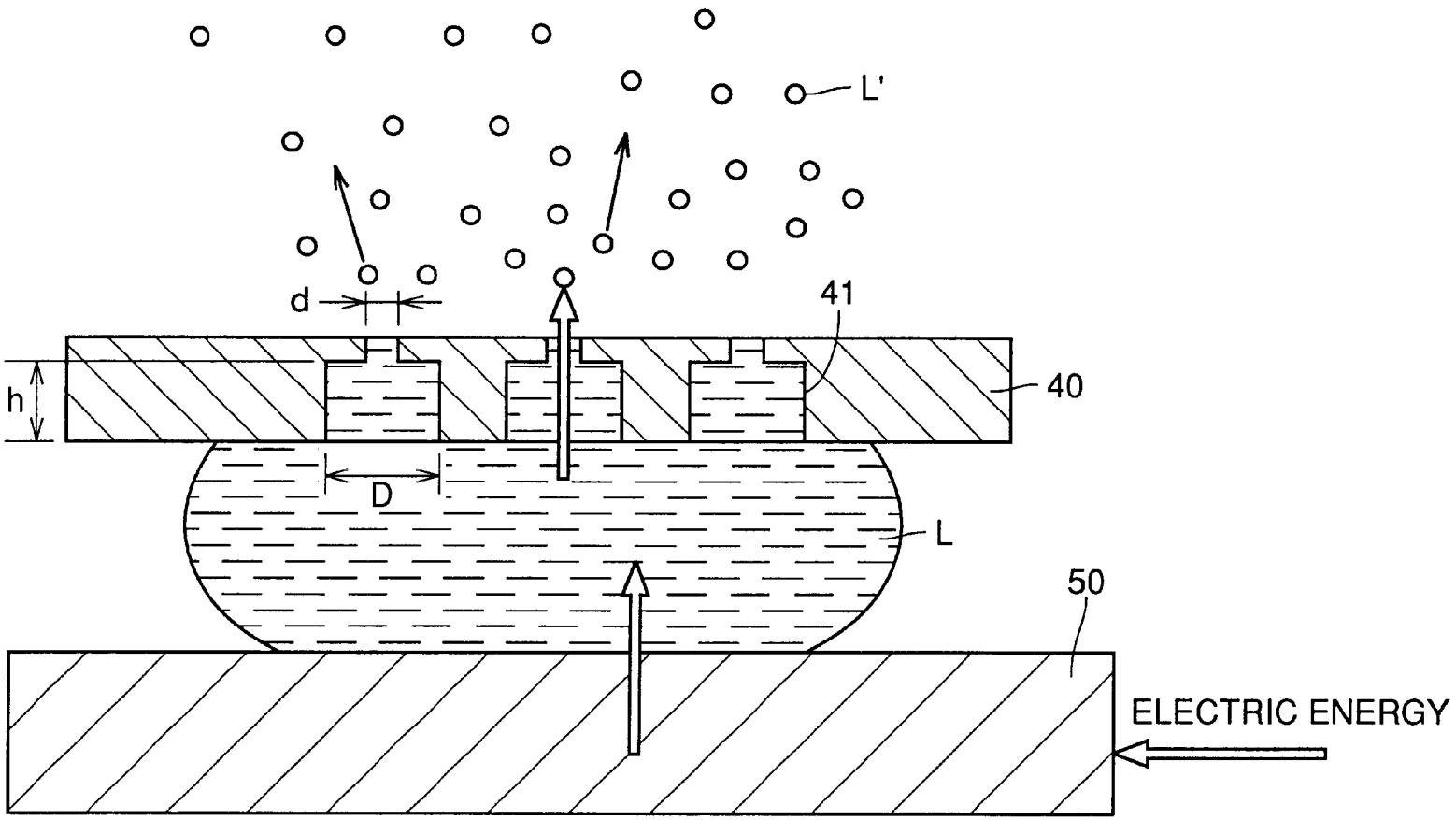
FIG. 21 is an enlarged sectional view of the main part describing atomization of an atomizer.

Atomization of the present atomizer will be described with reference to FIG. 21 (enlarged sectional view of the main part). By conducting an alternating current across electrodes 51 and 52 of piezoelectric element 50, surface wave 60 out of surface wave 60 and bulk wave 61 generated at piezoelectric element 50 (refer to FIG. 16) is canceled by virtue of the configuration of no-electrode formation portions 53–53*c* shown in FIGS. 18A, 18B and 18C and the configuration of end planes 54*a*–54*c* shown in FIGS. 19A, 19B and 19C. Only bulk wave 61 is propagated to mesh member 40, whereby mesh member 40 vibrates. The plurality of small holes 41 in mesh member 40 shown herein are of a stepped type horn configuration having an opening of a large diameter at the side of piezoelectric element 50 and an opening of a small diameter at the opposite side.

Liquid L is present between piezoelectric element 50 and mesh member 40. The oscillation energy of piezoelectric element 50 is propagated to liquid L, which in turn is propagated to mesh member 40. By the vibration of mesh member 40, liquid L is diffused from small hole 41 of mesh member 40 as atomized particles L'. In order to increase the amplitude displacement of the ultrasonic vibration to improve the atomization efficiency, the cross sectional shape of small hole 41 corresponds to an ultrasonic horn shape that is determined by the ultrasonic oscillation frequency and the sound speed of the liquid. As an example thereof, the cross section of small hole 41 corresponds to a stepped type horn configuration. Assuming that the sound speed of spray liquid (spray particle L') is 1500 m/s, the ultrasonic oscillation frequency is 6 MHz, the wavelength is λ, the amplitude enlargement rate of (D/d) 2 is obtained by setting step position h to 62.5 μm equal to λ/4 to obtain atomization of favorable efficiency with a relatively low power.

More specifically, mesh member 40 exhibits the highest atomization efficiency by the following conditions.

$$h=\lambda/4,\ \lambda=v/f$$

h: inlet hole depth of small hole 41 v: sound speed of liquid reagent

λ: wavelength f: oscillation frequency $$s\cdot(D/d)2$$

s: amplification rate

D: inlet hole diameter of small hole 41 d: outlet hole diameter of small hole 41

The cross sectional configuration of small hole 41 may be the horn shape of a conical type, a catenoidal or exponential type.

The cases corresponding to a small hole 41 of the conical type and exponential type horn configuration will be described hereinafter.

Figure 22A:
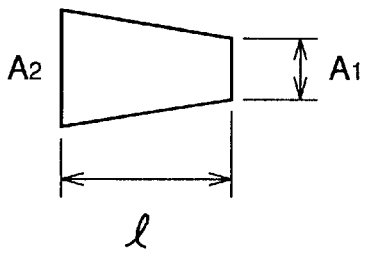
FIGS. 22A and 22B show the case where the mesh cross section configuration is of a conical type and an exponential type.
Figure 22B:
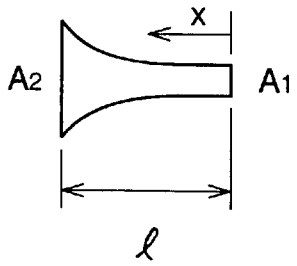

FIGS. 22A and 22B show conical type and exponential type horn-shaped small holes 41*a* and 41*b*, respectively. In the drawings, A1 and A2 represent the cross sectional area at the end plane of each type and l represents the depth of small hole 41.

In FIG. 22A, the frequency equation is represented as below.

$$\tan k'l = \frac{(\beta-1)^2 k'l}{(k'l)^2\beta + (\beta-1)^2}$$

$$k' = \frac{2\pi f}{\upsilon} : f \text{ is frequency}$$

$$\beta = \sqrt{\frac{A2}{A1}} : \upsilon \text{ is sound speed}$$

Referring to FIG. 22B, the cross sectional area Ax at a distance x from end plane A1 is represented by the following equation.

$$Ax = Ale^{hx}$$

where h is a taper constant.

In this case, the frequency equation is represented as below.

$$k'l = \frac{\pi}{q}$$

$$k' = \frac{2\pi f}{\upsilon}$$

$$q = \sqrt{1-P^2}$$

$$p = \frac{h}{2k'}$$

By any of the above horn configurations, the amplification rate and amount of atomization are greater than those of the conventional straight shape (straight round hole) or a reticulated hole. In other words, atomization of favorable efficiency is realized.

Figure 3:
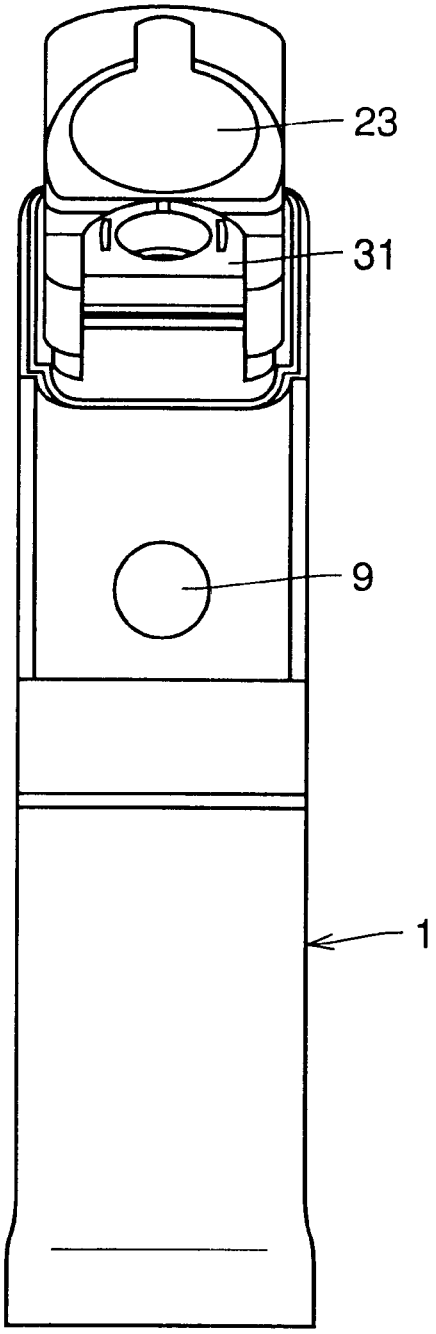
FIG. 3 is a front view of the atomizer of FIG. 2.

As shown in FIGS. 1–3, a projection 1*a*is present at the rear of the upper portion of main unit case 1 when the present atomizer is used. Since operation switch 9 is provided at a front face opposite to projection 1*a*(taking into account the human engineering nature), operation switch 9 can be operated with main unit case 1 grasped naturally. Since main unit case 1 can be grasped with a natural grip, the possibility of main unit case 1 being dropped during handling is low.

Since the present atomizer has liquid reagent bottle 20 and atomize unit 30 formed integrally at main unit cover 10 as shown in FIGS. 6A and 6B, piezoelectric element 50 is exposed when upper and lower parts 21 and 22 and upper and lower cases 31 and 32 are removed from main unit cover 10. Accordingly, the exposed surface of piezoelectric element 50 (no-electrode formation plane) can be easily cleaned with a cotton bud or the like. In view of the fact that the exposed surface of piezoelectric element 50 is easily contaminated due to the attachment and drying of liquid reagent and also adherence of dust, maintenance is facilitated by the above structure.

Liquid reagent bottle 20 (upper and lower parts 21 and 22) and the attachment portion of piezoelectric element 50 are coupled and held with respect to each other by being attracted by a magnet accommodated in a pair of magnet storage units 82 provided opposite at lower part 22.

According to the atomizer of FIG. 5, control circuit substrate 85 and an oscillation circuit substrate (not shown) are arranged in main unit case 1 whereas liquid reagent bottle 20, mesh member 40, piezoelectric element 50 and the like are arranged at main unit cover 10. By providing the components such as piezoelectric element 50 that have the possibility of being damaged by erroneous handling in the form of modular components of main unit cover 10, maintenance is improved by removing main unit cover 10 from main unit case 1. For example, main unit cover 1 or each substrate in main unit case 1, when damaged, can be easily exchanged. As to the spray mechanism portion (mesh member 40 and the like) required for critical adjustment, the accuracy can be maintained since they are provided as modular components that cannot be easily detached. Thus, assembly thereof is improved.

Industrial Applicability

According to the atomizer of the present invention, a piezoelectric element with comb-type electrodes having electrodes formed alternately is combined with a mesh member, wherein a bulk wave traveling within the piezoelectric element is used as the vibratory wave, not the surface wave propagating at the surface defined by the comb-type electrode pitch of the piezoelectric element. Therefore, stable atomization with favorable spray out efficiency is obtained.

What is claimed is:

1. An atomizer comprising:

a piezoelectric element including comb-type electrodes having one electrode and another electrode formed alternately, oscillation means driving said piezoelectric element, a mesh member including many small holes arranged in close proximity to said piezoelectric element, a reservoir storing a liquid, and liquid supply means for supplying the liquid in said reservoir between said piezoelectric element and said mesh member, wherein a vibratory wave of said piezoelectric element used for atomization by said oscillation means is mainly a wave traveling within the piezoelectric element.

2. The atomizer according to claim 1, wherein said piezoelectric element is of a material of lithium niobate, and has a 41±15° rotation Y cut and Y axis projection propagation direction.

3. The atomizer according to claim 1, wherein said piezoelectric element has a thickness so that an oscillation frequency of a surface wave and the oscillation frequency of a bulk wave differ from each other.

4. The atomizer according to claim 1, wherein comb-type electrodes of said piezoelectric element are arranged so that an oscillation frequency of a surface wave differs from the oscillation frequency of a bulk wave.

5. The atomizer according to claim 1, wherein an end portion of said piezoelectric element crossing at least an advancing direction of a surface wave is of a configuration that does not cause interference between a wave reflected at the end portion and said surface wave.

6. The atomizer according to claim 5, wherein the configuration that does not cause interference between said wave reflected at an end portion and said surface wave have both end planes asymmetric/or having at least the end plane of one said end portion nonplanar.

7. The atomizer according to claim 1, wherein said piezoelectric element has two opposite planes, said comb-type electrode being provided only at one plane side of said piezoelectric element.

8. The atomizer according to claim 7, wherein said comb electrode is provided at a plane opposite to the plane facing said member.

9. The atomizer according to claim 7, wherein said piezoelectric element includes a liquid detection electrode detecting absence/presence of said liquid, provided adjacent to one side of said comb-type electrode.

10. The atomizer according to claim 1, wherein the vibratory wave used for said atomization is formed and generated by said piezoelectric element formed to reduce effect by a surface wave traveling through a surface of said piezoelectric element.

11. The atomizer according to claim 1, wherein a cross sectional configuration of said small hole is of a horn configuration determined by an ultrasonic vibration frequency and a sound speed of said liquid.

12. An atomizer comprising a piezoelectric element including comb-type electrodes having one electrode and another electrode formed alternately, oscillation means driving said piezoelectric element, a mesh member including many small holes arranged in close proximity to said piezoelectric element, a reservoir storing a liquid, and liquid supply means for supplying the liquid in said reservoir between said piezoelectric element and said mesh member, wherein a cross sectional configuration of the small hole of said mesh member is of a horn configuration formed according to an oscillation frequency of the piezoelectric element and a sound speed of the liquid.

13. An atomizer comprising a piezoelectric element including comb-type electrodes having one electrode and another electrode formed alternately, oscillation means driving said piezoelectric element, a mesh member including many small holes arranged in close proximity to said piezoelectric element, a reservoir storing a liquid, and liquid supply means supplying the liquid in said reservoir between said piezoelectric element and said mesh member, wherein said piezoelectric element and mesh member are arranged so that their facing planes cross at an acute angle, and the liquid from the liquid supply means is supplied from an opening side therebetween.

14. An atomizer comprising a piezoelectric element including comb-type electrodes having one electrode and another electrode formed alternately, oscillation means driving said piezoelectric element, a mesh member including many small holes arranged in close proximity to said piezoelectric element, a reservoir storing a liquid, and liquid supply means supplying the liquid in said reservoir between said piezoelectric element and said mesh member, wherein said piezoelectric element and said mesh member are arranged so that their facing planes cross at an acute angle, and said reservoir includes a liquid supply pipe extending to an opening side between said piezoelectric element and mesh member.

15. An atomizer comprising a piezoelectric element including comb-type electrodes having one electrode and another electrode formed alternately, oscillation means driving said piezoelectric element, a mesh member including many small holes arranged in close proximity to said piezoelectric element, a reservoir storing a liquid, and liquid supply means supplying the liquid in said reservoir between said piezoelectric element and said mesh member, wherein said piezoelectric element includes a liquid sense electrode sensing liquid from the reservoir at a comb-type electrode formation plane, a liquid sense circuit substrate sensing absence/presence of liquid according to a signal from the liquid sense electrode is provided, the liquid sense circuit substrate arranged below the comb-type electrode formation plane of the piezoelectric element, and the liquid sense electrode of the piezoelectric element and the liquid sense circuit substrate are electrically connected by a conductive resilient body.

16. An atomizer comprising a piezoelectric element including comb-type electrodes having one electrode and another electrode formed alternately, oscillation means driving said piezoelectric element, a mesh member including many small holes arranged in close proximity to said piezoelectric element, a reservoir storing a liquid, and liquid supply means supplying the liquid in said reservoir between said piezoelectric element and said mesh member, wherein said liquid supply means supplies the liquid in said reservoir by urge-operating a diaphragm.

17. An atomizer comprising a piezoelectric element including comb-type electrodes having one electrode and another electrode formed alternately, oscillation means driving the piezoelectric element, a mesh member including many small holes arranged in close proximity to the piezoelectric element, a reservoir storing the liquid, liquid supply means supplying the liquid in the reservoir between the piezoelectric element and the mesh member, and liquid amount sense means sensing an amount of liquid on the piezoelectric element, wherein said liquid supply means supplies the liquid in the reservoir by urge-operating a diaphragm, and the urge-operation of the diaphragm is controlled according to an output of said liquid amount sense means.

18. An atomizer comprising a piezoelectric element including comb-type electrodes having one electrode and another electrode formed alternately, oscillation means driving the piezoelectric element, a mesh member including many small holes arranged in close proximity to the piezoelectric element, a reservoir storing the liquid, liquid supply means supplying liquid in the reservoir between the piezoelectric element and the mesh member, and a mesh member case holding the mesh member, wherein said mesh member case is formed of metal or ceramic.

* * * * *

UNITED STATES PATENT AND TRADEMARK OFFICE

CERTIFICATE OF CORRECTION

PATENT NO. : 6,273,342 B1
DATED : August 14, 2001
INVENTOR(S) : Takao Terada et al.

It is certified that error appears in the above-identified patent and that said Letters Patent is hereby corrected as shown below:

Column 10,
Line 57, change "s•(D/d)2" to -- $s=(D/d)^2$ --.

Signed and Sealed this

Twenty-sixth Day of February, 2002

*Attest:*

*Attesting Officer*

JAMES E. ROGAN
*Director of the United States Patent and Trademark Office*